US006158975A

United States Patent [19]

Dill et al.

[11] Patent Number: 6,158,975

[45] Date of Patent: Dec. 12, 2000

[54] FUEL PUMP MODULE

[75] Inventors: Shawn Dill, New Carlisle, Ohio; Peter P. Kuperus; Ronald H. Roche, both of Cass City, Mich.; Tomoko Takano, Clawson, Mich.

[73] Assignee: Walbro Corporation, Cass City, Mich.

[21] Appl. No.: 09/159,456

[22] Filed: Sep. 24, 1998

[51] Int. Cl.[7] ..... F04B 49/00; F02M 37/04

[52] U.S. Cl. ..... 417/307; 123/509; 123/514

[58] Field of Search ..... 417/307, 423.3, 417/423.9, 423.15; 123/509, 511, 514, 516

[56] References Cited

U.S. PATENT DOCUMENTS

| | | | |
|---|---|---|---|
| 5,195,494 | 3/1993 | Tuckey | 123/514 |
| 5,219,277 | 6/1993 | Tuckey | 417/366 |
| 5,257,916 | 11/1993 | Tuckey | 417/423 |
| 5,881,698 | 3/1999 | Tuckey et al. | 123/497 |

*Primary Examiner*—Noah P. Kamen
*Assistant Examiner*—Mahmoud M Gimie
*Attorney, Agent, or Firm*—Reising, Ethigton Barnes, Kisselle, Learman & McCulloch, P.C.

[57] ABSTRACT

A fuel pump module constructed to be disposed exteriorly of a vehicle fuel tank carries, as a single unit, an electric motor fuel pump and a pressure control device which controls the pressure of fuel delivered to an internal combustion engine from the fuel pump. Fuel supplied from the fuel tank to the module is drawn into the fuel pump which increases the pressure of the fuel and then discharges the fuel under pressure from an outlet of the fuel pump which communicates with the pressure control device carried by the module and an outlet of the module which in turn, communicates with the engine. The pressure control device may be either a pressure relief valve, which functions to limit the maximum pressure of the fuel delivered to the engine, or a fuel pressure regulator, such as a bypass pressure regulator, which bypasses to a point upstream of the fuel pump inlet fuel delivered from the fuel pump in excess of the engine's fuel demand. Mounting the pressure control device and fuel pump in a common module reduces the number of fuel lines in the fuel system and avoids the problems associated with return fuel systems which return heated, excess fuel from a hot fuel rail. Desirably, a fuel filter is provided at the fuel pump inlet and a foam shell is also disposed in the fuel pump module to reduce sloshing of the fuel and vibrations in the module and to permit a module to securely carry fuel pumps of different size. Thus, the fuel pump module according to this invention is versatile, compact and readily assembled into a wide variety of fuel systems.

19 Claims, 4 Drawing Sheets

FUEL PUMP MODULE

FIELD OF THE INVENTION

This invention relates generally to internal combustion engines and more particularly to a fuel supply system for internal combustion engines.

BACKGROUND OF THE INVENTION

Electric fuel pumps have been widely used to supply fuel from a supply tank to an internal combustion engine. In automotive applications an electric fuel pump is generally mounted within a gasoline fuel supply tank however, in some non-automotive applications, such as motorcycles, the tank size or shape makes it impractical to mount the pump within the fuel tank. Thus, in these situations the fuel pump must be mounted externally of the fuel tank. In other applications, such as in marine engines, the fuel pump is generally mounted externally of the gasoline fuel tank with a secondary pump used to provide fuel from the fuel tank to the main fuel pump.

Prior fuel pumps mounted externally of the fuel tank have been mounted in modules constructed to receive fuel from the fuel tank whereupon that fuel is drawn through the fuel pump and delivered under pressure from the fuel pump to the operating engine. Typically, in these systems, if a fuel pressure regulator is provided it is disposed on the fuel raii adjacent to the engine and it returns excess fuel from the fuel rail to the fuel tank. Having passed through the fuel rail adjacent to the operating engine, the fuel returned from the fuel pressure regulator is at an elevated temperature and when it is discharged into the fuel tank it generates a significant amount of fuel vapor in the fuel tank which is undesirable. Further, additional assembly and fuel line connections are required to connect the separate fuel pump module and fuel pressure regulator in the fuel system.

SUMMARY OF THE INVENTION

A fuel pump module constructed to be disposed exteriorly of a vehicle fuel tank carries, as a single unit, an electric motor fuel pump and a pressure control device which controls the pressure of fuel delivered to an internal combustion engine from the fuel pump. Fuel may flow directly from the fuel tank to the fuel pump module such as under the influence of gravity or pump suction; or a secondary supply pump may provide fuel to the fuel pump module from the fuel tank. Fuel within the module is then drawn into the fuel pump to increase its pressure and then discharged under pressure from an outlet of the fuel pump which communicates with the pressure control device carried by the module. The pressure control device may be either a pressure relief valve, which functions to limit the maximum pressure of the fuel delivered to the engine, or a fuel pressure regulator, such as a bypass pressure regulator, which bypasses to a point upstream of the fuel pump inlet the fuel delivered from the fuel pump which is in excess of the engine's fuel demand.

Desirably, the fuel pump module also has a fuel filter therein adjacent to the inlet of the fuel pump. Further, the fuel pump module preferably has a cylindrical shell of a reticulated or open cell foam surrounding the fuel pump within the fuel pump module which attenuates or eliminates sloshing of the fuel inside of the module to provide a substantially continuous supply of fuel to the fuel pump even during extreme acceleration of the vehicle, separates some of the vapor from the liquid fuel in the module to improve the efficiency of the fuel pump and may dampen vibrations in the module to extend the service life of the electric and mechanical components of the fuel pump module.

Thus, the fuel pump module provides filtered fuel having a lower vapor content to the fuel pump which then supplies that fuel to an operating engine at a pressure controlled by the pressure control device carried by the module. Further, the fuel pump module is preferably constructed to contain a small quantity of fuel to provide a fuel reservoir to ensure a substantially continuous supply of fuel at the fuel pump inlet even when the fuel supply from the fuel tank may become interrupted such as during rapid acceleration of the vehicle.

Objects, features and advantages of this invention include providing a fuel pump module mounted exteriorly of the fuel tank which provides an electric motor fuel pump which supplies fuel under pressure to an operating engine, a fuel pressure control device which controls the pressure at which fuel is delivered to the engine, a fuel filter, a reserve fuel reservoir, a foam shell surrounding the fuel pump to substantially eliminate sloshing of fuel inside of the module and to separate some of the vapor from the liquid fuel in the module and to dampen vibrations of the module, is constructed as a single unit to reduce the cost and weight of the module and to minimize the number of fuel line connections needed to connect the module into the fuel supply system, is of relatively simple design and economical manufacture and assembly and has a long useful life in service.

BRIEF DESCRIPTION OF THE DRAWINGS

These and other objects. features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
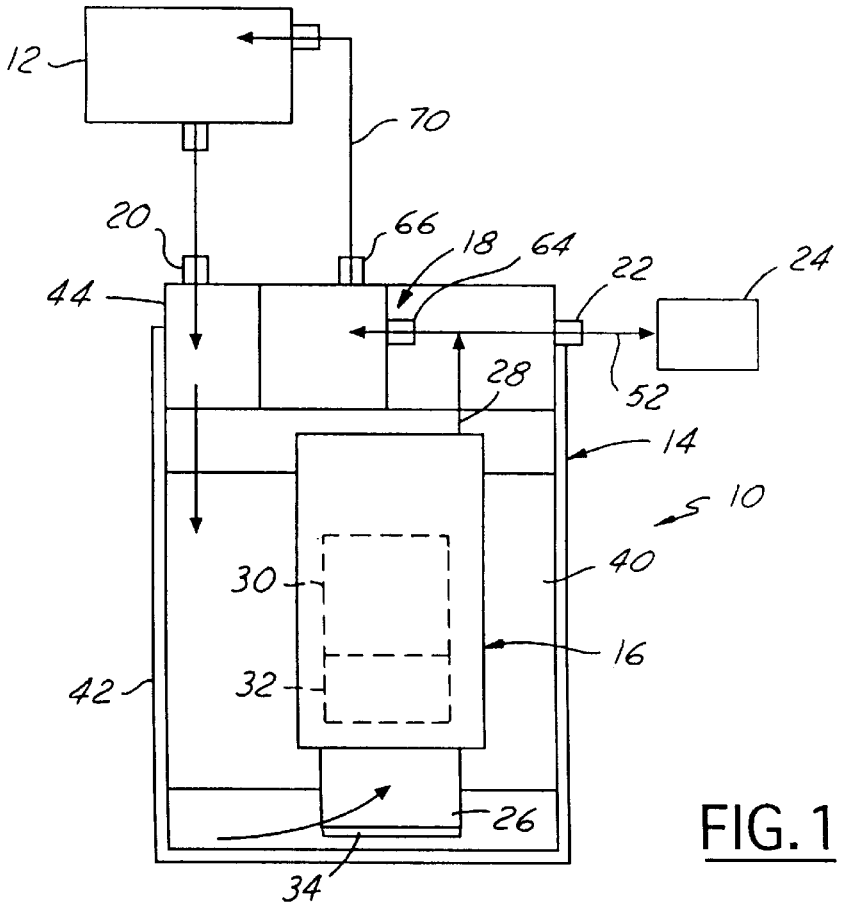
FIG. 1 is a diagrammatic view illustrating a fuel pump module embodying the invention and disposed in a fuel system between a fuel tank and an engine.

Referring in more detail to the drawings, FIGS. 1–4 illustrate a fuel pump module 10 according to the invention mounted exteriorly of a gasoline fuel supply tank 12 and having a housing 14 which carries an electric motor fuel pump 16 and a fuel pressure control device 18 as a single unit. The module 10 has an inlet 20 through which fuel is received from the fuel tank 12 and an outlet 22 through which fuel is delivered to an engine 24. Fuel received through the module inlet 20 is drawn into an inlet 26 of the fuel pump 16 and thereafter discharged from an outlet 28 of the fuel pump 16 under pressure. The outlet 28 of the fuel pump 16 communicates with the fuel pressure control device 18 which preferably is a bypass fuel pressure regulator which bypasses to a point upstream of the fuel pump inlet 26, the fuel delivered from the fuel pump 16 which is in excess of the engine's 24 fuel demand. Preferably, fuel bypassed by the fuel pressure regulator 18 is sent to the fuel tank 12. Fuel not bypassed by the fuel pressure regulator 18 is discharged from the outlet 22 of the module 10 to supply the engine's 24 fuel demand at a fuel flow rate corresponding to the engine's fuel demand. To insure an adequate fuel supply to the engine 24. the fuel pump 16 preferably supplies fuel at a rate at least slightly greater than the engine's maximum fuel demand. Thus, at least a small portion of the fuel discharged from the fuel pump 16 is bypassed back to the fuel tank 12. The relatively small volume of fuel which may be contained in the housing 14 of the module 10 helps to insure a substantially continuous supply of fuel at the inlet 26 of the fuel pump 16 even when the supply of fuel from the fuel tank 12 may become interrupted such as during extemely low fuel level conditions in the tank 12 or when the vehicle is rapidly accelerating or navigating sharp turns.

The fuel pump 16 may be of substantially any type such as a gear rotor type fuel pump as disclosed in U.S. Pat. No. 5,219,277, or a regenerative or turbine type fuel pump such as disclosed in U.S. Pat. No. 5,257,916. the disclosures of which are incorporated herein by reference in their entirety. In general, the fuel pump 16 has an electric motor 30 which drives a pumping assembly 32 to both draw fuel through the inlet 26 and discharge that fuel under pressure from the outlet 28 of the fuel pump 16. Preferably, a fuel filter 34 is disposed surrounding the inlet 26 of the fuel pump 16 to remove harmful contaminants from the fuel before it is drawn into the fuel pump 16.

Figure 2:
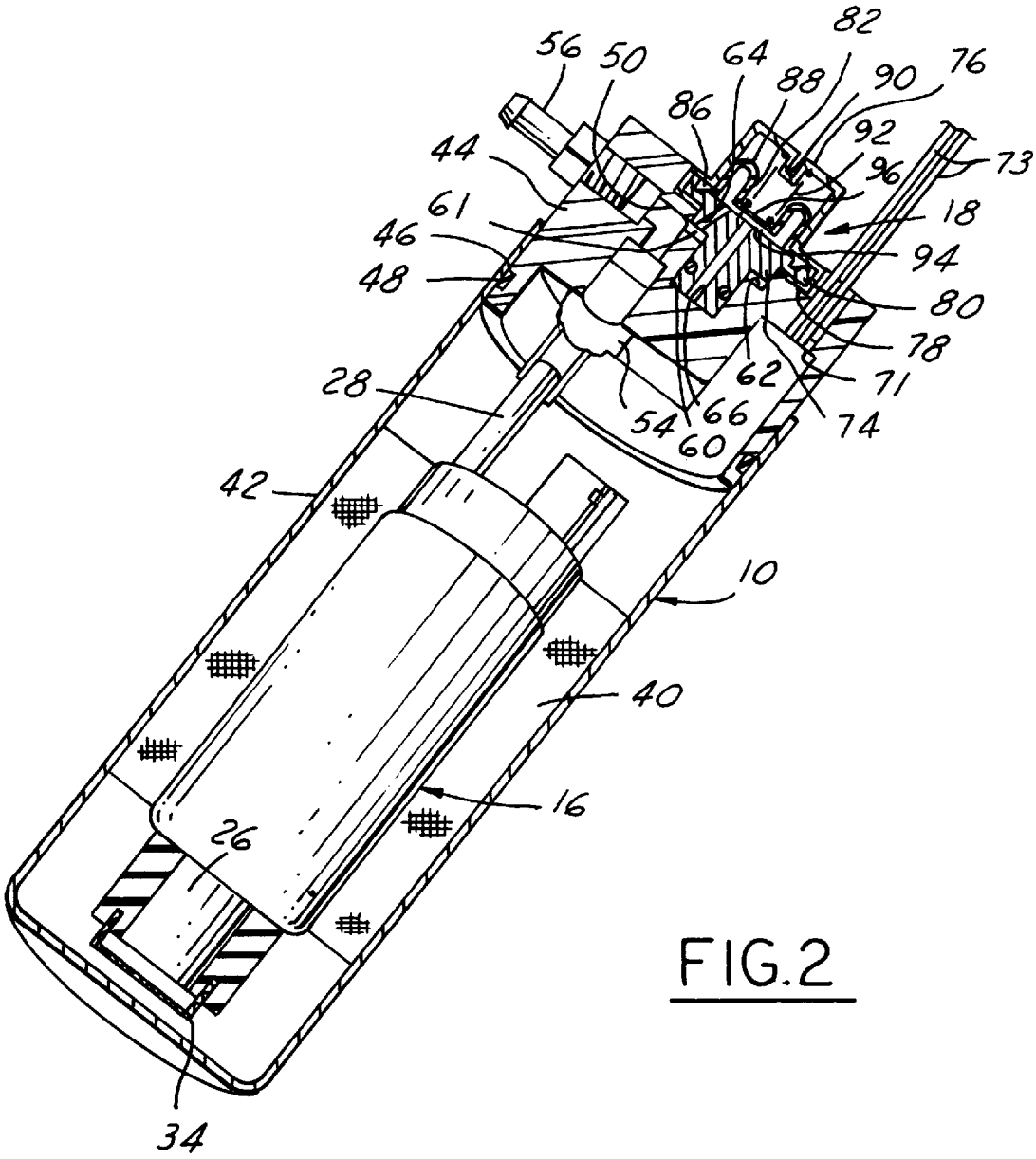
FIG. 2 is a cross sectional view of the fuel pump module of FIG. 1.
Figure 4:
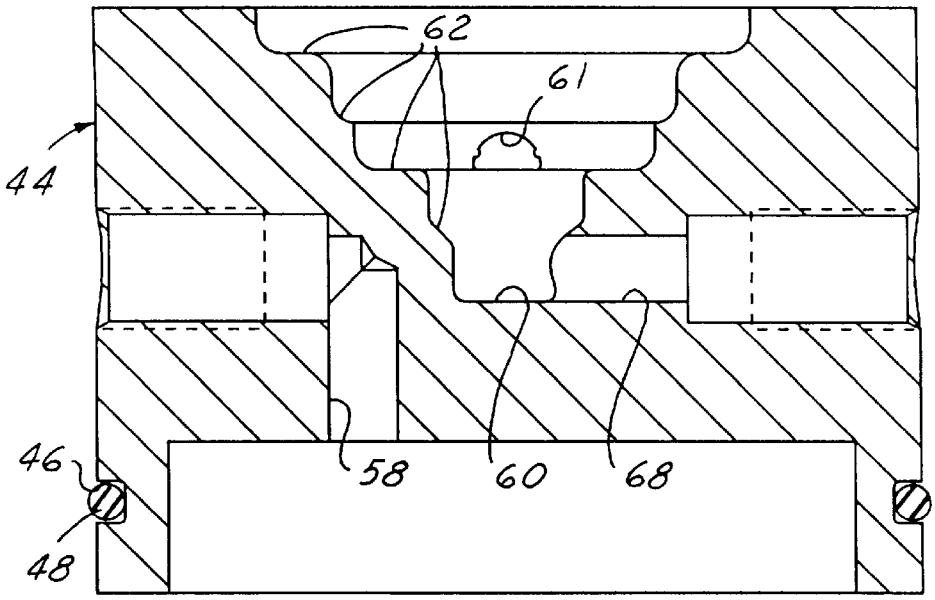
FIG. 4 is a cross-sectional view taken along line 4—4 in FIG. 3.

Preferably, as shown in FIG. 2, an annular, generally cylindrical shell 40 of a reticulated or open cell foam material is disposed within the module housing 10 and surrounds the fuel pump 16. The foam shell 40 attenuates sloshing of fuel within the module 10 to provide a generally continuous supply of fuel at the fuel pump inlet 26 even during extreme acceleration of the vehicle which would otherwise cause significant sloshing of the fuel such that at times, fuel would be absent from the inlet of the fuel pump. The foam shell 40 also separates at least a portion of the fuel vapor from the liquid fuel in the module 10 as the fuel flows through the shell to reduce the fuel vapor drawn into the fuel pump 16 and thereby increase the efficiency of the fuel pump. Preferably, the foam shell 40 has an average pore size on the order of 10 microns to 200 microns. However, it can be a larger pore open cell foam. Further, the flexible foam shell 40 dampens vibration from the electric fuel pump 16 to prolong the life of the electrical and mechanical components of the module 10. The flexible material of the foam shell 40 also permits different sized fuel pumps to be received within the fuel pump module 10 without any design changes so that the fuel pump module 10 can be used in a wide variety of applications.

The housing 14 of the fuel pump module 10 has a cylindrical, hollow body 42 open at one end and constructed to telescopically receive a cap 44 press fit therein. The body 42 is of a size sufficient to receive the fuel pump 16, the foam shell 40 and a small quantity of liquid fuel. Preferably, an annular groove 46 formed in the cap receives a seal 48 such as an O-ring to prevent fuel leakage between the body 42 and cap 44.

Figure 3:
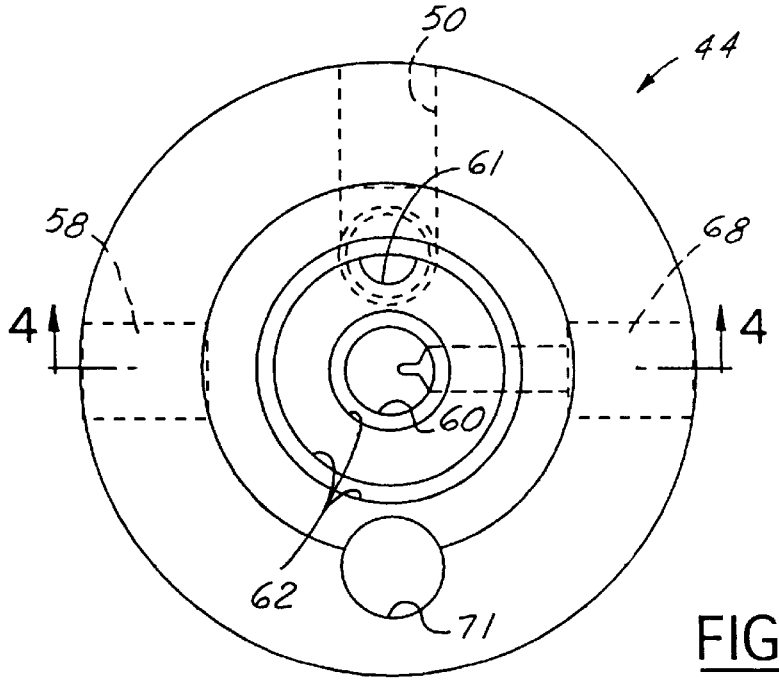
FIG. 3 is a top view of a cap of the fuel pump module housing.

As best shown in FIGS. 2 and 3 the cap 44 has an L-shaped outlet passage 50 formed therein communicating the fuel pump outlet 28 with a fuel line 52 (FIG. 1) through which fuel is delivered to the engine 24. Preferably, a pair of couplers 54, 56 (FIG. 2) are provided, each pressed into one end of the passage 50 to communicate the fuel pump outlet 28 and fuel line 52, respectively, with the passage 50. An inlet passage 58 in the cap 44 provides the fuel inlet to the module 10 communicating the interior of the housing 14 with the fuel supply tank 12. A blind bore 60 and one or more counterbores 62 provide a pocket in which the fuel pressure regulator 18 is received. Preferably, the fuel pressure regulator 18 is inserted into the stepped blind bores 60 and 62 in the cap 44 and sealed with two O-rings in a typical application to prevent leakage therebetween. The outlet passage 50 preferably communicates with a hole 61 which opens into a counterbore 62 of the cap 44 to communicate fuel discharged from the fuel pump 16 with an inlet 64 of the fuel pressure regulator 18. An outlet 66 of the fuel pressure regulator 18 communicates with a blind bore 68 in the cap 44 through which fuel bypassed by the regulator 18 is routed to the fuel tank 12 through a bypass fuel line 70 (FIG. 1). An opening 71 through the cap 44 receives electrical wires 73 to provide electricity to the fuel pump 16.

As shown in FIG. 2, which shows a typical fuel pressure regulator, the fuel pressure regulator 18 has a housing defined by a body 74 and a cap 76. To retain the cap 76 on the body 74, a peripheral edge 78 of the cap 76 is preferably rolled around a radially extending flange 80 of the body 74. A diaphragm 82 received between the cap 76 and the body 74 has a relatively thin and flexible central portion and a circumferentially continuous peripheral rib 86 received in a groove in the body 74 and retained therein by the cap 76. Preferably, to provide a more flexible and responsive diaphragm, it has a circumferentially continuous pleat or bellows 88. The cap 76 has a depressed portion 90 constructed to retain and locate one end of a spring 92 which yieldably biases the diaphragm 82 onto an annular seat 94 surrounding the bypass outlet 66 of the fuel pressure regulator 18 to close the bypass outlet 66. Preferably, a retainer 96 is disposed between the spring 92 and the diaphragm 82 to locate that end of the spring 92 and to prevent damage to the diaphragm 82.

Fuel which enters the inlet 64 of the fuel pressure regulator 18 is communicated with the diaphragm 82 which is yieldably biased by the spring 92 to close the bypass outlet 66 of the fuel pressure regulator 18. When the force of the fuel acting on the diaphragm 82 is sufficient to overcome the force of the spring 92 biasing the diaphragm 82 as well as the diaphragm's own resistance to displacement, the diaphragm 82 is displaced from the seat 94 and fuel may flow through the bypass outlet 66 of the fuel pressure regulator 18 to be discharged back into the fuel tank 12. As described earlier, the fuel pump 16 preferably provides fuel at a higher rate than the engine's maximum fuel demand so that the diaphragm 82 is normally displaced from the seat 94 and at least a portion of the fuel discharged from the fuel pump 16 is returned to the fuel tank 12. Alternatively, the fuel pressure control device 18 may be a pressure relief valve which remains closed until a threshold pressure is reached at the inlet of the valve whereupon the valve opens to bypass fuel to the fuel tank 12 until the pressure of fuel drops below the threshold. The fuel pressure regulator or pressure relief valve may be of substantially any construction sufficient to control the pressure of fuel delivered to an operating engine 24 and bypass excess fuel to the fuel tank 12.

Figure 5:
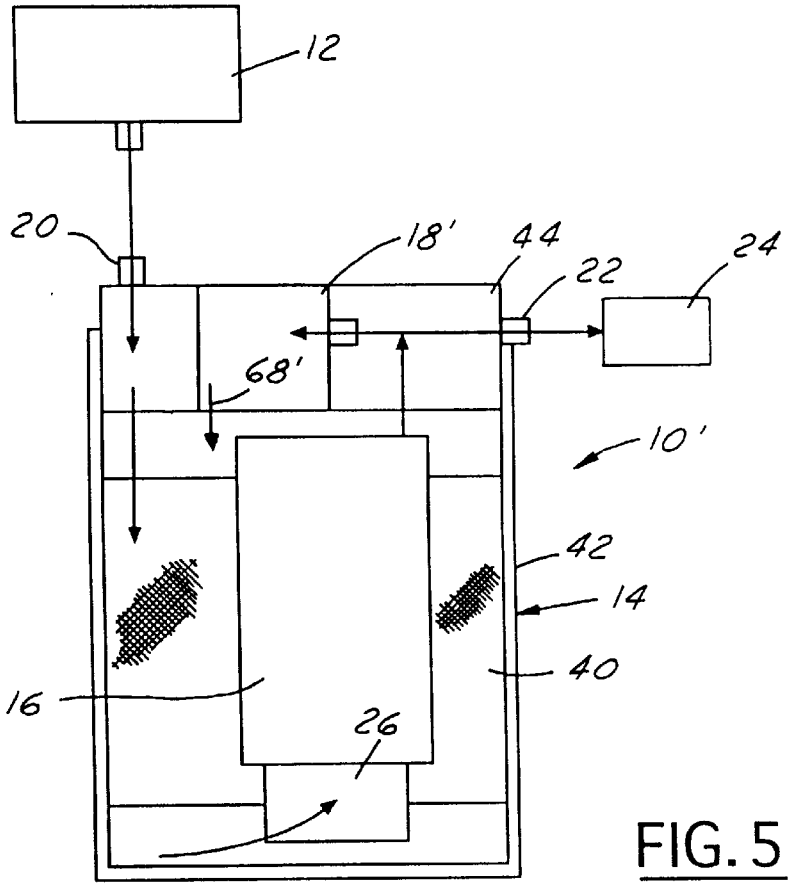
FIG. 5 is a diagrammatic view of a fuel pump module wherein the fuel pressure regulator of the fuel pump module bypasses excess fuel into the interior of the fuel pump module.

Alternatively, as shown in FIG. 5 a modified fuel pump module 10' may be provided having a fuel pressure regulator 18' wherein the bypass fuel is discharged directly into the module housing 14 through an outlet passage 68' formed through the cap 44. Preferably, each of the other components of the fuel pump module 10' is the same as described for the module 10 and hence, will not be described again.

Figure 6:
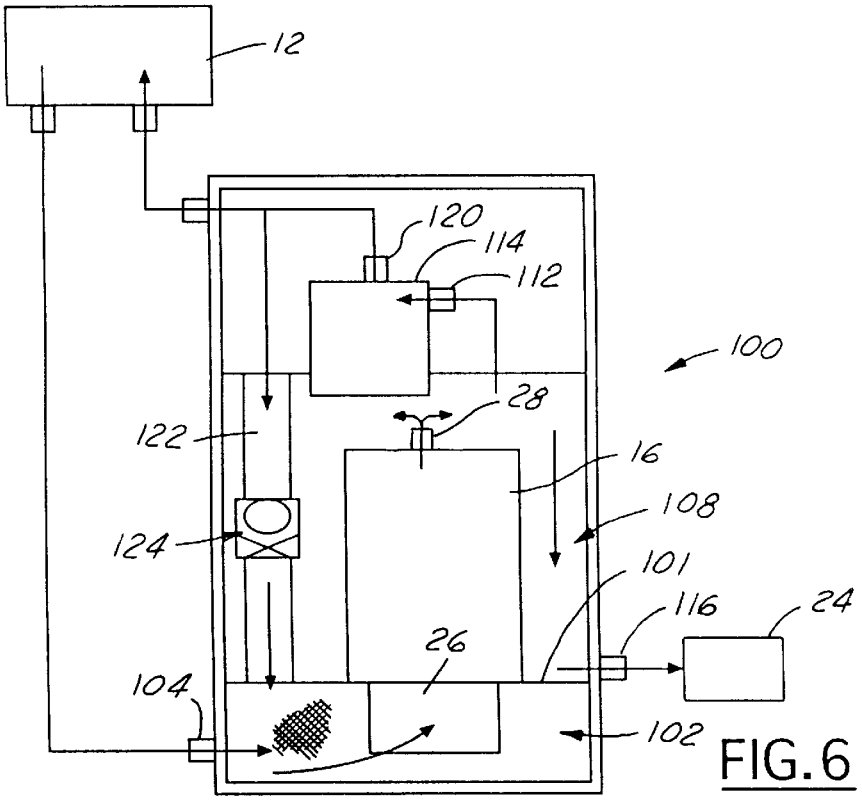
FIG. 6 is a diagrammatic view of an alternate embodiment of a fuel pump module embodying this invention.

FIG. 6 illustrates an alternate embodiment of a fuel pump module 100 having an interior wall 101 defining a low pressure chamber 102 with an inlet 104 communicating with the fuel pump inlet 26 and the fuel tank 12 to provide fuel to the fuel pump inlet 26 and a separate, high pressure chamber 108 communicating with the outlet 28 of the fuel pump 16. In this embodiment, fuel is discharged from the fuel pump directly into the high pressure chamber 108 which communicates with both the inlet 112 of a bypass pressure regulator 114 and an outlet 116 of the module 100 to deliver pressurized fuel to an engine 24. Excess fuel delivered from the fuel pump 16 is bypassed by the regulator 114 to the fuel tank 12, through a bypass outlet 120. Optionally, a secondary return line 122 may be provided in communication with the outlet 120 of the bypass pressure regulator 114 to bypass a portion of the fuel from the bypass pressure regulator 114 into the low pressure chamber 102 of the module 100 so that the bypassed fuel may be drawn into the fuel pump 16. Preferably, the secondary return line 122 has a check valve 124 therein which function as a pressure relief valve and prevents flow from the secondary return line 122 into the low pressure chamber 102 until the pressure drop provided by the fuel pump 16 downstream of the check valve 124 is sufficient to open the check valve 124. In use, if fuel is absent from the fuel pump inlet 26, a sufficient drop in pressure will be applied to the check valve 124 to open it so that bypass fuel in the secondary return line 122 can be discharged into the low pressure chamber 102 to supply fuel to the fuel pump 16.

Figure 7:
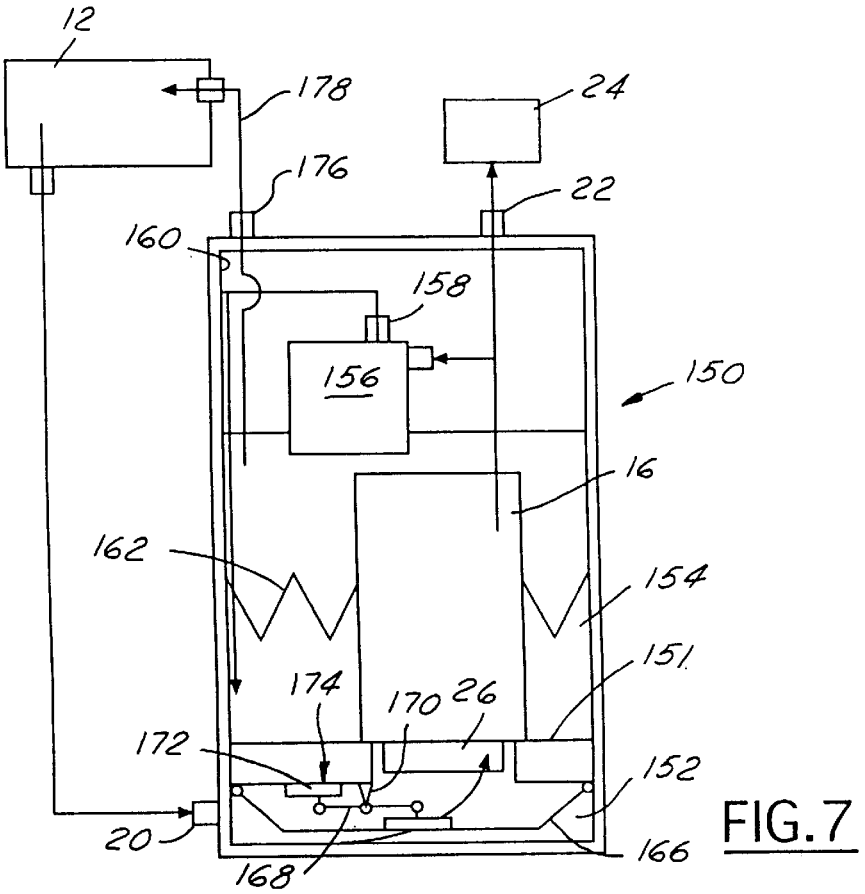
FIG. 7 is a diagrammatic view of a third embodiment of a fuel pump module embodying this invention.

FIG. 7 illustrates a third embodiment of a fuel pump module 150 having an interior wall 151 defining inlet fuel chamber 152 and a reservoir chamber 154 constructed to receive fuel bypassed from a fuel pressure regulator 156. To reduce the formation of fuel vapor in the fuel pump module 150 as the bypass fuel is discharged into the reservoir chamber 154, the outlet 158 of the bypass pressure regulator 156 preferably discharges onto an interior wall 160 of the fuel pump module 150 so that thereafter, fuel flows down the wall 160 to decrease the splashing or sloshing of the fuel discharged into the reservoir chamber 154. The fuel preferably also flows through a screen 162 (or a foam shell 40 as in the first embodiment fuel pump module 10) to further reduce the fuel vapor within the liquid fuel in the module 150.

Preferably, the fuel pump inlet 26 is surrounded by a fuel filter 166 having openings small enough to remove significant contaminants from the fuel and large enough to permit the relatively free flow of liquid fuel through the filter 166. When fuel is absent from the fuel pump inlet 26. the capillary action of the wetted filter material prevents the passage of air or fuel vapor through the filter and the filter is drawn upwardly towards the fuel pump. As the filter 166 is displaced upwardly a valve 168 is rotated about a pivot 170 to displace a valve head 172 from an opening 174 in the interior wall 151 to permit fuel in the reservoir chamber 154 to flow into the inlet chamber 152 to supply fuel to the fuel pump inlet 26. Thus, the reservoir chamber 154 provides a small volume of reserve fuel so that a generally continuous supply of fuel is present at the fuel pump inlet 26 even under extremely low fuel level conditions in the fuel tank or during extreme vehicle acceleration when fuel may be absent from the outlet of the fuel tank such that there is an interruption in supply of fuel to the inlet chamber 152 of the module 150. Optionally, the inlet chamber 152 may be disposed in a separate end cap removably press fit onto a substantially closed end of the module 150 to facilitate cleaning or replacing the filter 166. A vent 176 may be provided to permit fuel vapor in the module 150 to escape to the fuel tank 12 through a suitable conduit 178.

In a single unit, each of the fuel pump modules 10, 10', 100, 150 of this invention provide at least a fuel pump 26, a fuel reservoir to contain at least a small volume of liquid fuel, a fuel filter 32 or 166 and a pressure control device 18, 18', 114, 156 which controls the pressure of fuel delivered to the engine 24. The modules 10, 10', 100, 150 reduce the number of fuel lines interconnecting them between the fuel tank 12 and the engine 24 to reduce the complexity of the system and also the possibility of fuel leakage. Further, a module 10, 10' 100, 150 can accommodate different fuel pumps 16 as well as fuel pressure control devices so that it may be used in a wide range of applications.

What is claimed is:

1. A fuel pump module comprising:

a housing constructed to be mounted exteriorly of a vehicle fuel tank and defining a closed chamber for low pressure fuel having an inlet to receive fuel from a fuel tank remote from the housing;

an electric motor fuel pump received in the closed chamber of the housing and having an inlet in communication with only the interior of the closed chamber of the housing and spaced from the inlet of the closed chamber and an outlet through which fuel is discharged for delivery to an engine remote from the housing; and a fuel control device carried by the housing and having an inlet in communication with the fuel pump outlet and an outlet through which excess fuel delivered from the fuel pump outlet is discharged to supply to the engine through the outlet a fuel supply corresponding to the fuel demand of the engine, and constructed and arranged so that fuel from a fuel tank is supplied to the housing through the housing inlet into the closed chamber and the fuel pump draws fuel from the interior of the closed chamber into its inlet and discharges fuel under pressure through its outlet for delivery to the engine and the fuel control device controls the pressure of fuel discharged from the outlet to the engine and routes excess fuel discharged from the fuel pump to a point upstream of the fuel pump inlet and to at least one of the closed chamber and the fuel tank remote from the housing.

2. The fuel pump module of claim 1 wherein the outlet of the fuel control device communicates with the fuel tank.

3. The fuel pump module of claim 1 wherein the outlet of the fuel control device communicates with the interior of the fuel pump module housing.

4. The fuel pump module of claim 1 wherein the fuel control device is a bypass pressure regulator which bypasses to the fuel tank fuel delivered from the fuel pump outlet in excess of the engine's fuel demand to provide a fuel supply to the engine corresponding to the engine's fuel demand.

5. The fuel pump module of claim 1 wherein the fuel control device is a pressure relief valve which is normally closed to prevent fuel flow through its outlet and opens when the pressure at the housing outlet exceeds a threshold pressure to route fuel through its outlet to the fuel tank to limit the maximum pressure of fuel delivered to the engine.

6. The fuel pump module of claim 1 which also comprises a filter disposed in the housing and communicating with the fuel pump inlet.

7. The fuel pump module of claim 6 wherein the filter is carried by the housing.

8. The fuel pump module of claim 1 which also comprises an open cell foam shell disposed within the housing and around at least a portion of the fuel pump.

9. The fuel pump module of claim 8 wherein the foam shell is disposed in the housing between the housing inlet and the fuel pump inlet.

10. The fuel pump module of claim 8 wherein the foam shell is formed of an at least somewhat flexible material to accommodate fuel pumps of various sizes.

11. The fuel pump module of claim 1 wherein the housing comprises a body having one open end and a cap substantially closing the open end of the body to define an enclosure in which the fuel pump is received.

12. The fuel pump module of claim 11 wherein the fuel control device is carried by the cap.

13. The fuel pump module of claim 11 wherein the cap is press-fit on the body.

14. The fuel pump module of claim 11 wherein the cap and body are formed of a polymeric material suitable for use with hydrocarbon fuel.

15. The fuel pump module of claim 1 which also comprises a vapor outlet of the housing in communication with the fuel tank and constructed to permit the flow of fuel vapor from the housing to the fuel tank.

16. The fuel pump module of claim 1 which also comprises an interior wall in the housing defining an inlet chamber on one side of the wall and a high pressure fuel chamber on the other side of the wall, the fuel pump draws fuel through the fuel pump inlet from the inlet chamber and discharges fuel under pressure from the fuel pump outlet into the high pressure fuel chamber which communicates with the housing outlet and the fuel control device inlet.

17. The fuel pump module of claim 16 which also comprises an opening through the wall and a valve constructed to selectively close the opening to prevent communication between the inlet chamber and the high pressure fuel chamber until fuel is absent from the fuel pump inlet whereupon the valve opens to provide fuel from the high pressure fuel chamber to the fuel pump inlet.

18. The fuel pump module of claim 1 which also comprises.

a wall in the housing separating an inlet chamber of the housing from a fuel reservoir of the housing, the inlet chamber communicates the housing inlet with the fuel pump inlet and the fuel reservoir communicates with the outlet of the fuel control device;

an opening through the wall; and a valve yieldably biased to a closed position closing the opening and moveable to an open position to permit fuel flow from the fuel reservoir to the inlet chamber to supply fuel discharged from the fuel control device to the fuel pump inlet.

19. The fuel pump module of claim 1 wherein the fuel control device is integral with the housing.

* * * * *